US011771233B1

(12) United States Patent
Ducker et al.

(10) Patent No.: US 11,771,233 B1
(45) Date of Patent: Oct. 3, 2023

(54) PIVOTABLY DEPLOYABLE KNEE-CUSHION ASSEMBLY FOR HOME INDOOR AND OUTDOOR USAGE

(71) Applicants: Andrew Leslie Ducker, Coral Springs, FL (US); Brett Franklin Ducker, Coral Springs, FL (US)

(72) Inventors: Andrew Leslie Ducker, Coral Springs, FL (US); Brett Franklin Ducker, Coral Springs, FL (US)

( * ) Notice: Subject to any disclaimer, the term of this patent is extended or adjusted under 35 U.S.C. 154(b) by 30 days.

(21) Appl. No.: 17/535,292

(22) Filed: Nov. 24, 2021

(51) Int. Cl.
*A47C 16/04* (2006.01)
*A47C 16/02* (2006.01)

(52) U.S. Cl.
CPC ..... *A47C 16/04* (2013.01); *A47C 16/025* (2013.01)

(58) Field of Classification Search
CPC ..... A47C 16/025; A47C 16/02; A47C 13/00; A47C 16/04; A47C 7/543
USPC ..... 108/94; 297/411.31, 423.44
See application file for complete search history.

(56) References Cited

U.S. PATENT DOCUMENTS 3,325,830 A * 6/1967 Black ..... A47C 17/32 5/8
4,779,540 A * 10/1988 Dion ..... F16M 13/02 108/98
4,789,046 A * 12/1988 McDowall ..... E04F 21/24 2/24
6,516,483 B1 * 2/2003 VanSteenburg .... A61G 7/05715 5/737
7,320,502 B1 * 1/2008 McCloskey ..... A47C 16/04 297/DIG. 6
8,616,652 B1 * 12/2013 Wells ..... A47C 16/025 D3/270
8,850,645 B1 * 10/2014 Jackson ..... A47C 4/52 5/655.9
9,700,158 B1 * 7/2017 Reed ..... A47F 5/16
2011/0250009 A1 * 10/2011 Swanson ..... A47B 9/18 29/428
2015/0148205 A1 * 5/2015 Fides ..... A63B 21/4029 482/142

FOREIGN PATENT DOCUMENTS

KR 1486188 B1 * 1/2015 ..... A47C 11/00

* cited by examiner

*Primary Examiner* — Milton Nelson, Jr.
(74) *Attorney, Agent, or Firm* — Frank L. Kubler

(57) ABSTRACT

A knee-cushion assembly includes an oval forward panel and an oval rearward panel, each cushioned with high density, closed cell foam, which are pivotally interconnected to fan apart to a deployed configuration for use, and to pivot into an overlapping, closed configuration for compact storage. The panels are pivotally interconnected by a pin structure. When deployed, the front faces of both panels are presented and accessible so that a user can rest a knee on each, to protect their knees from the impact, pressure, discomfort and injury that can be caused by placing knees directly on a hard support surface such as a floor. A magnet preferably is secured to the rearward surface of the rearward panel so that the assembly can be magnetically attached to any flat steel surface.

27 Claims, 7 Drawing Sheets

PIVOTABLY DEPLOYABLE KNEE-CUSHION ASSEMBLY FOR HOME INDOOR AND OUTDOOR USAGE

FILING HISTORY

This application continues from provisional patent application Ser. No. 63/258,423 filed on May 3, 2021, the contents of which are incorporated herein by reference.

BACKGROUND OF THE INVENTION

1. Field of the Invention

The present invention relates generally to the field of knee protection devices for performing various tasks, and more specifically relates to forward and rearward cushion panels pivotally interconnected to fan apart to a deployed configuration for use, and to pivot into an overlapping, closed configuration for compact storage. The cushion panels are pivotally interconnected by a pin structure in the form of a pin, button or rivet as below-described. When deployed, the front faces of both panels are presented and accessible so that a user can rest a knee on each, to protect their knees from the impact, pressure, discomfort and injury that can be caused by placing them directly on a hard support surface, such as a floor. The panels preferably have the same shape and size, and the pin structure preferably is located closely adjacent to corresponding edges of each, so that when the panels are fanned apart on the pin structure, the front face of the rearward panel is broadly exposed, and both panel front faces are presented to each support a user knee. Then they can pivot to overlap fully and register with each other in their closed configuration.

The forward and rearward panels preferably are elliptically- or oval-shaped, with the pin structure being located adjacent a narrow end of each, so that they cover a wide area when fanned apart. The panels preferably are each formed of closed cell high-density foam. Each panel is substantially one inch thick for a consumer version, which can firmly and comfortably support knees carrying 250 pounds weight, and is substantially 1.5 inches thick for an industrial version to firmly and comfortably support knees carrying 350 pounds weight. The front face of each panel preferably is covered with a protective layer, such as of vinyl. A logo may be printed or otherwise displayed on the forward panel front face, such as on the vinyl. The back face of each panel preferably is covered with a protective layer. A magnet, preferably in the form of a flexible sheet magnet, is adhesively secured to the back face of the back panel, and has adequate magnetic force to support the assembly when placed against a steel surface, such as against the front or side of a refrigerator, or the side of a metal tool cabinet, or to an outdoor steel storage shed, so that it is easy to store, see or locate. To releasably secure the assembly in its closed configuration between uses, a locking mechanism preferably is provided. The forward and rearward panels optionally are optionally formed of UV glow-foam to glow at night and recharge from ambient light during the day.

2. Description of the Prior Art

There have long been knee-pads for protecting knees when a user kneels, such as to work on an appliance or a car, or to garden. Some prior knee-pads are sleeves which fit around the knees and thus are inconvenient to use, and typically do not provide adequate protection. Others are individual padded structures which can become separated so that both are not readily available or can be located at a given moment.

It is thus an object of the present invention to provide a pivotally deployable knee-cushion assembly having two cushion panels, each for supporting a user knee, which are interconnected so that they never become separated and both are always available.

It is another object of the present invention to provide such a knee-cushion assembly in which the two cushion panels are interconnected pivotally, so that they can fan apart to a broad configuration where both panels are presented for use, and pivot into overlapping relation to a closed configuration for compact storage, and thus has the dual benefits of broad deployment and compact storage.

It is still another object of the present invention to provide such a knee-cushion assembly with magnetic mounting means so that it can be magnetically and removably anchored to a steel surface such as the side wall of a refrigerator, side wall of a freezer located in a garage, or side wall of a rolling or non-rolling metal tool box in a garage or an interior side wall of a metal shed, so that it is easy to store, see and locate.

It is finally an object of the present invention to provide such a knee-cushion assembly which is very easy to use and inexpensive to manufacture.

SUMMARY OF THE INVENTION

The present invention accomplishes the above-stated objectives, as well as others, as may be determined by a fair reading and interpretation of the entire specification.

A knee-cushion assembly is provided, including cushioned forward and a rearward panels which are pivotally interconnected to fan apart to a deployed configuration for use, and to pivot into an overlapping, closed configuration for compact storage. The panels are pivotally interconnected by a pin structure. When deployed, the front faces of both panels are presented and accessible so that a user can rest a knee on each, to protect their knees from the impact, pressure, discomfort and injury that can be caused by placing knees directly on a hard support surface such as a floor. A flexible mounting magnetic sheet preferably is secured to the rearward surface of the rearward panel so that the assembly can be magnetically mounted to a steel surface.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
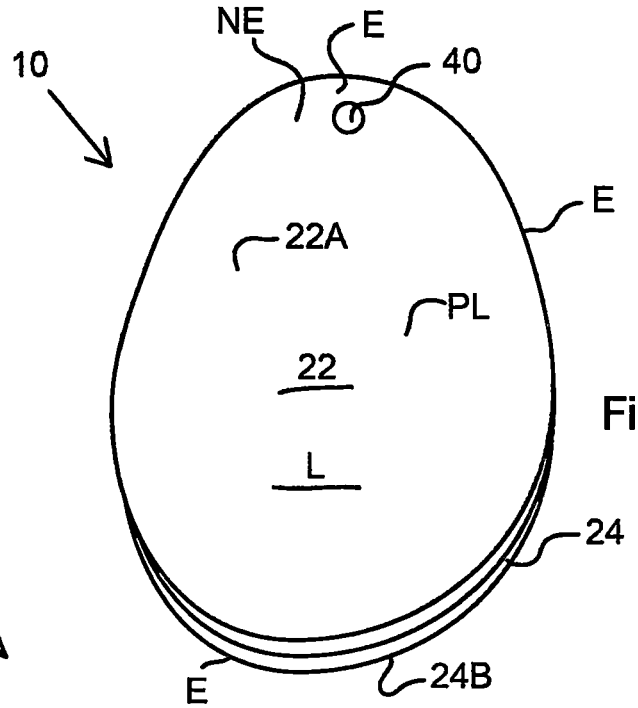
FIG. 1 is a perspective view of the assembly in its closed configuration.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention in the various FIGURES are designated by the same reference numerals.

First Preferred Embodiment

Figure 2:
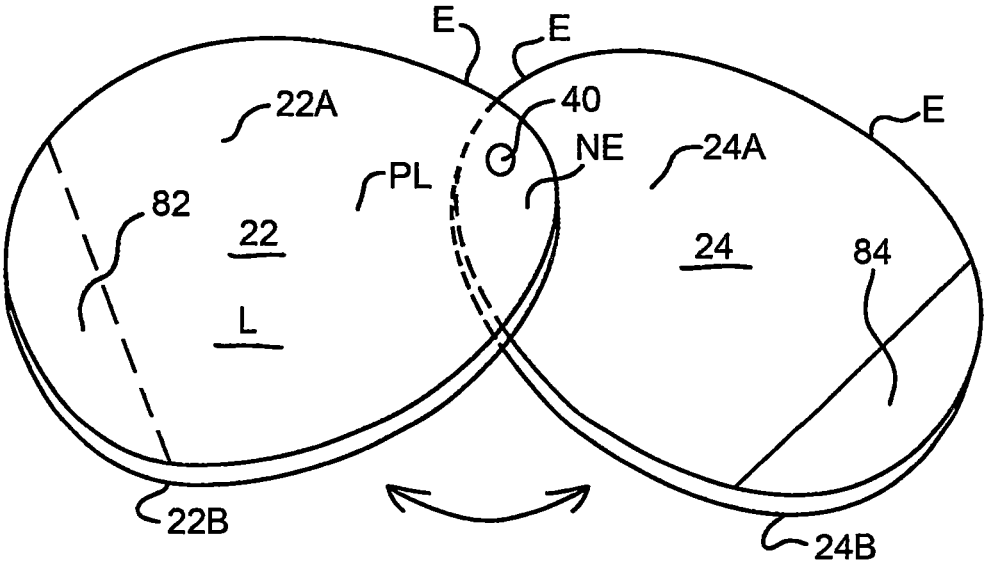
FIG. 2 is a view as in FIG. 1 of the assembly in its open configuration. The first locking magnetic sheet is shown in broken lines on the back face of the forward panel and the second locking magnetic sheet is shown in the front face of the rearward panel.
Figure 3:
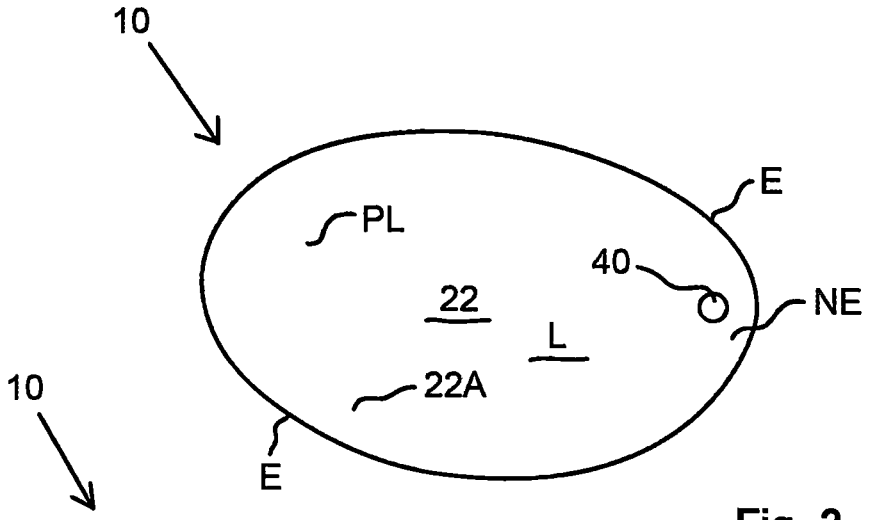
FIG. 3 is a top plan view of the assembly in its closed configuration.
Figure 4:
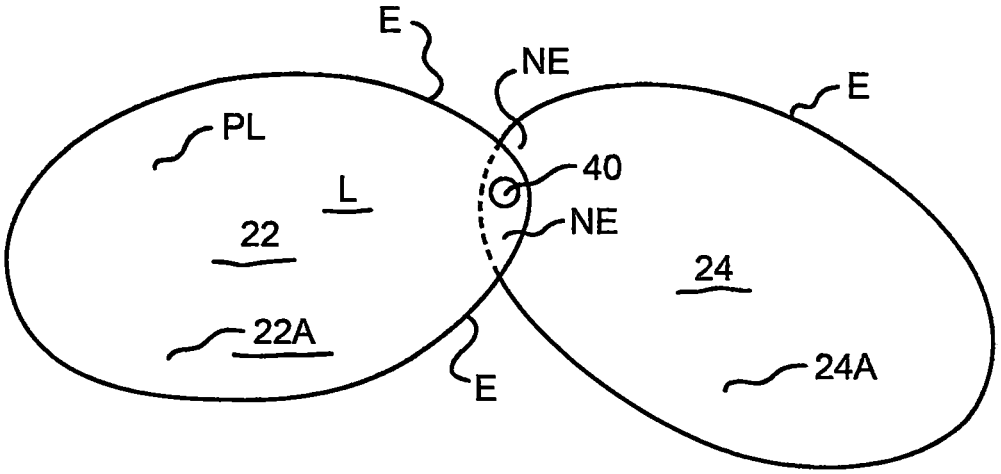
FIG. 4 is a view as in FIG. 3 of the assembly in its open configuration.
Figure 5:
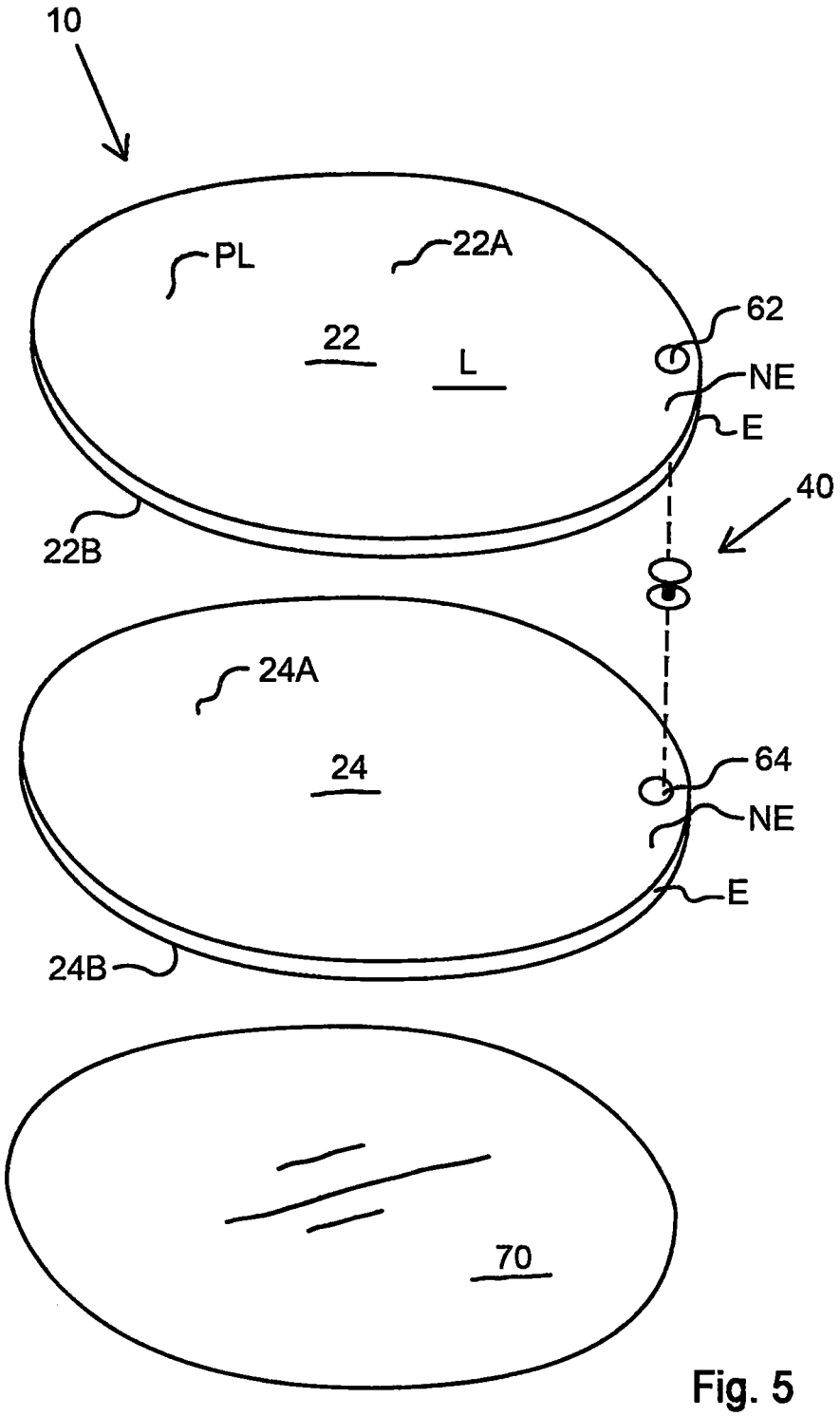
FIG. 5 is an exploded, perspective view of the assembly of FIGS. 1-4.
Figure 6:
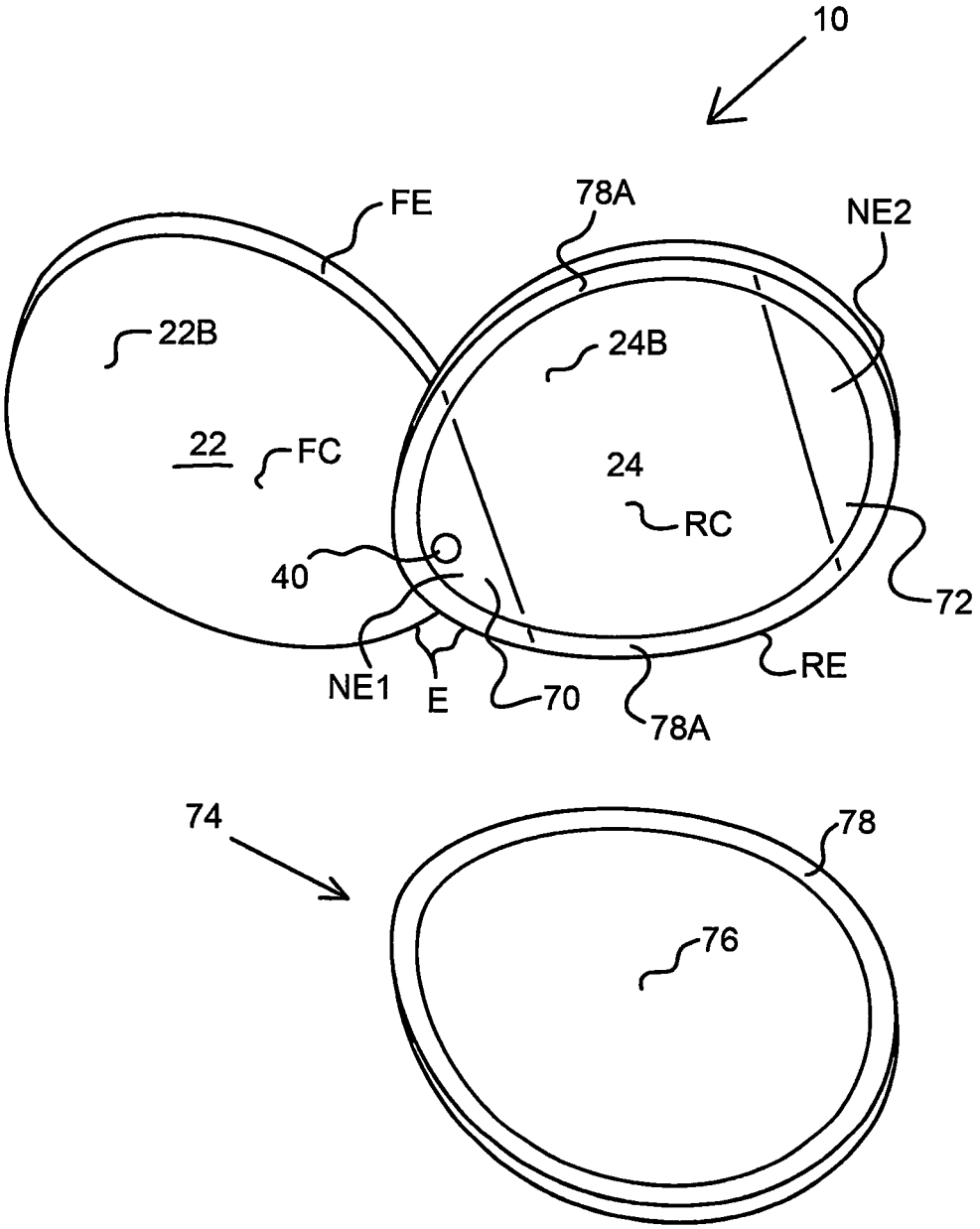
FIG. 6 is a perspective back view of the assembly, showing the first and second magnetic mounting end sheets on the back face of the rearward panel for removably mounting the assembly on an upright steel surface such as a refrigerator door. An optional cushion cover for protecting first and second magnetic mounting sheets is shown in exploded relation to the assembly.
Figure 7:
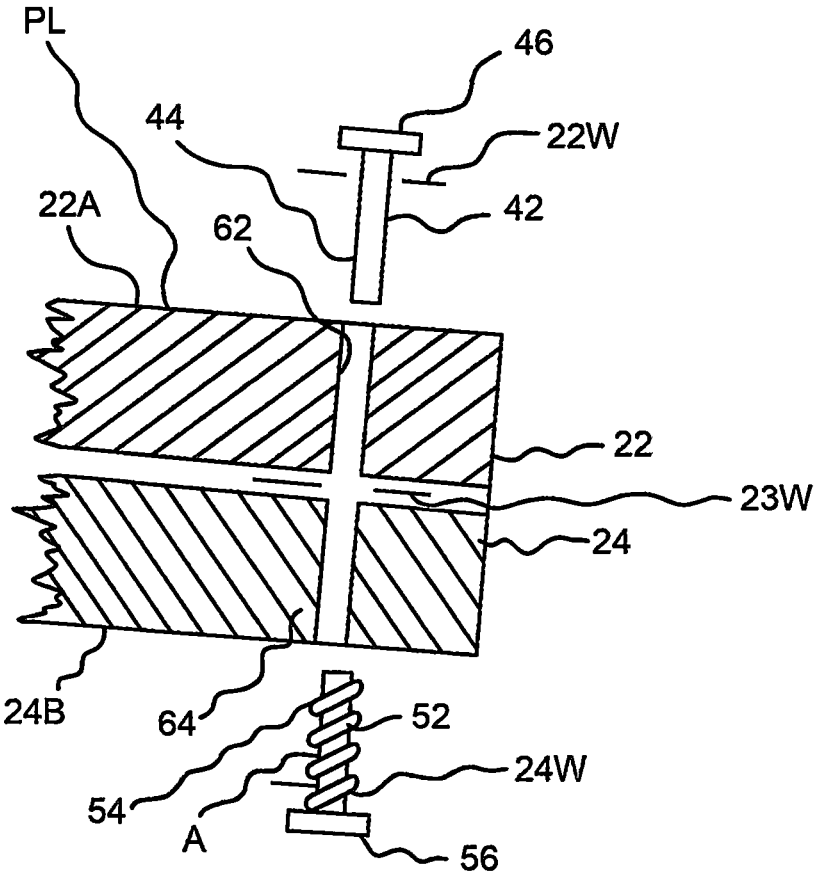
FIG. 7 is an exploded, broken-away, cross-sectional view of an end of the assembly showing the elements of the preferred pin structure.
Figure 8:
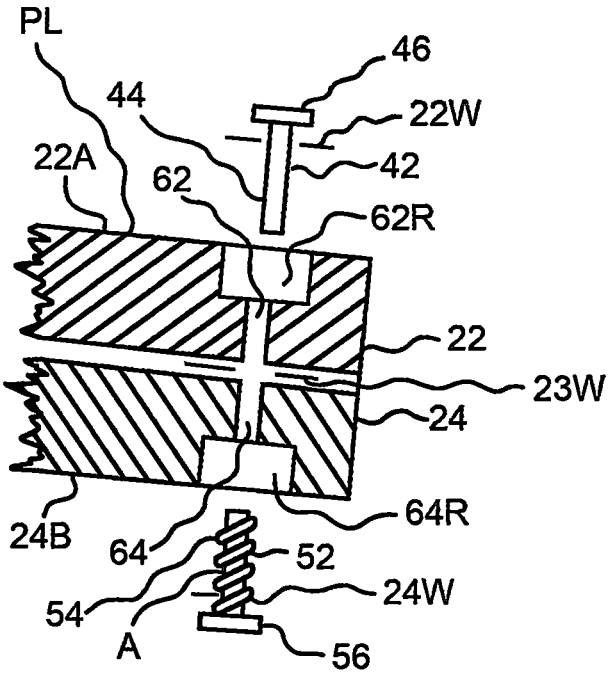
FIG. 8 is a broken away, exploded view of the pivoting end of the assembly showing the pin structure countersunk into the front face of the forward panel forming a forward recess and into the back face of the rearward panel forming a rearward recess to protect the user from contact with the pin structure during use.
Figure 9:
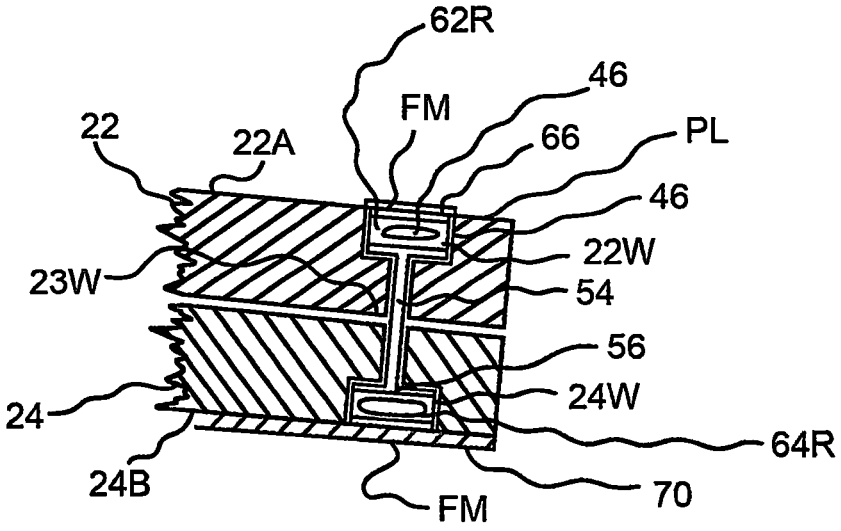
FIG. 9 is a view as in FIG. 8, but showing the assembly assembled and filler material placed into the forward and rearward recesses and a cover sheet placed over the forward recess and the second magnetic mounting end sheet covering the rearward recess.
Figure 10:
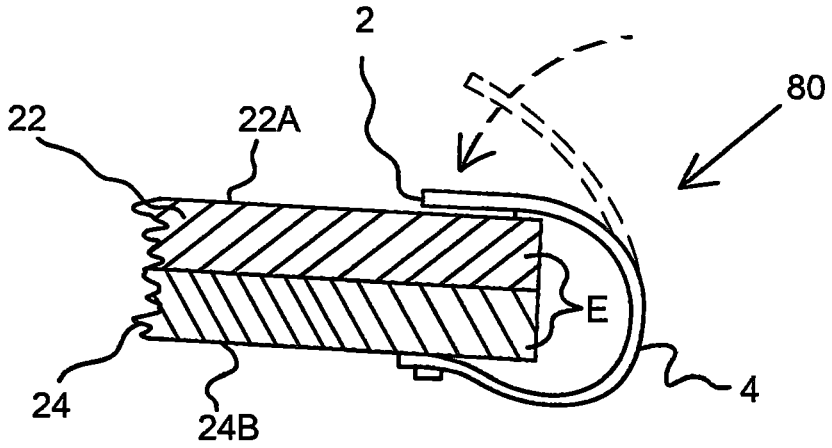
FIG. 10 is a broken-away edge view of an end of the assembly showing the locking mechanism, including the hook and loop fastener patch and strap, in the locked position.

Referring to FIGS. 1-10, a knee-cushion assembly 10 is disclosed having a cushioned forward panel 22 and a cushioned rearward panel 24 which are pivotally interconnected to fan apart to a deployed configuration for use, and to pivot into an overlapping, closed configuration for compact storage. See FIGS. 1 and 2, and 3 and 4. The panels 22 and 24 are pivotally interconnected by a pin, rivet or button, hereinafter pin structure 40, and have panel front faces 22A and 24A, respectively. When deployed, the panel front faces 22A and 24A of both panels 22 and 24 are presented and accessible so that a user can rest a knee on each, to protect the knees from the impact, pressure, discomfort and injury that can be caused by placing them directly on a hard support surface, such as a floor. The panels 22 and 24 preferably have the same shape and size, and the pin structure 40 preferably is located closely adjacent to corresponding edges E of each, so that when the panels 22 and 24 are fanned apart on the pin structure 40, the front face 24A of the rearward panel 24 is broadly exposed, and both panel front faces 22A and 24A are presented, as noted, to each support a corresponding user knee. Then they can pivot to overlap and register with each other fully in their closed configuration.

The forward and rearward panels 22 and 24 preferably are elliptically- or oval-shaped, with the pin structure 40 being located adjacent a narrow end NE of each, so that when fanned apart they cover a wide area. Forward panel 22 has a forward panel center point FC and a forward panel peripheral edge FE, and rearward panel 24 has a rearward panel center point RC and a rearward panel peripheral edge RE. An example of suitable measurements are, but are not limited to, front and back panels faces 22A, 22B, 24A and 24B each being 8 inches wide and 11.5 inches long, with the rotational axis of the pin structure 40 being located 1.5 inches from each of the forward panel edge. FE and the rearward panel edge RE, at corresponding panel narrow ends NE. The overall dimensions may differ from this example, but it is preferred that the proportions, that is, the ratios of width to length and distance of the pin structure 40 from panel edge FE and RE remains substantially the same as in this example.

The panels 22 and 24 preferably are each formed of closed cell high-density, water resistant neoprene foam. Each panel is substantially one inch thick for a consumer version, which can firmly and comfortably support knees carrying 200 pounds weight, and is substantially 1.5 inches thick for an industrial version to firmly and comfortably support knees carrying 350 pounds weight. The front face of each panel 22 and 24 preferably is covered with a protective layer PL, such as of vinyl. A logo L may be printed or otherwise displayed on the forward panel front face 22A, such as on the vinyl. The back faces 22B and 24B of each panel 22 and 24, respectively preferably is covered with a protective layer.

The pin structure 40 preferably includes a female portion 42 formed of an internally threaded tube 44 with a tube open end and a tube closed end covered by a blank tube head 46 having a width greater than the width of the tube 44, and a male portion 52 in the form of a machine screw consisting of a threaded shaft having a slotted screw head at one end. See FIG. 6. Pin structure passing holes in the form of pin passageways 62 and 64 are provided respectively in each of the forward and rearward panels 22 and 24. The panels 22 and 24 are positioned so that their pin passageways 62 and 64 mutually register, and the threaded tube 44 of the female portion 42 is fitted through the registering pin passageways 62 and 64, and the threaded shaft 54 of the male portion 52 is screwed into the internally threaded tube 44, so that the tube head 46 and the screw head 56 abut and hold the panels 22 and 24 in face-to-face abutting relation. A drop of anaerobic adhesive A is placed on the threaded shaft 54 before it is screwed into the tube 44 to prevent the male and female pivot portions 42 and 52 from loosening and disengaging.

The pin structure 40 preferably is sized to match the combined thickness of the forward and rearward panels 22 and 24, and all pin structure 40 parts preferably are formed of stainless steel. The forward and rearward ends of the pin structure 40 preferably include corresponding forward and rearward washers 22W and 24W, which fit around the internally threaded tube 44. Forward washer 22W fits between the forward panel front face 22A and the tube head 46, and preferably is 1.5 inches in diameter. Rearward washer 24W fits between rearward panel back face 24B and the screw head 56, and preferably is 0.5 inches in diameter. A center washer 23W is also provided between forward and rearward panels 22 and 24. Forward washer 22W, center washer 23W and rearward washer 24W preferably are all fender washers.

The assembled pin structure 40 preferably is shorter in length than the combined thicknesses of forward and rearward panels 22 and 24. The first pin passageway 62 in the forward panel 22 is counter-sunk into the forward panel front face 22A to define a forward recess 62R having a diameter matching that of the forward washer 22W into which the pin structure 40 forward end, including forward washer 22W, are seated. See FIGS. 8 and 9. The forward recess 62R is then filled with soft recess filler material FM, preferably in the form of non-sag, high strength, flexible polyurethane adhesive, which is then covered with a forward recess cover 66, preferably in the form of a circular hook and loop fastener patch 66 having a diameter matching that of the forward recess 62R. The soft filler material FM protects user knees or other user body areas from contact with the pin structure 40, and the filler material cover 66 protects the filler material FM from wear and tear.

Similarly, the second pin passageway 64 in the rearward panel 24 is counter-sunk into the rearward panel back face 24B to define a rearward recess 64R having a diameter matching that of the rearward washer 24W into which the pin structure 40 rearward end, including rearward washer 24W, are seated. See once again FIGS. 8-9. The rearward recess 64R is then filled with the same soft recess filler material FM used to fill forward recess 62R. Rearward recess 64R is then covered by the first mounting magnetic narrow end sheet 70 described above. Once again, the filler material FM protects the filler material FM respectively in forward and rearward recesses 62R and 64R from wear and tear.

A mounting magnet, preferably in the form of a flexible mounting sheet magnet 70, is adhesively secured to the back face 24B of the rearward panel 24, and has adequate magnetic force to removably secure and fully support the knee-cushion assembly 10 when placed against a steel surface. As a result, the assembly 10 can be stored simply by placing the rearward panel 24 against the front or side of a refrigerator or a steel tool cabinet. The mounting magnetic sheet at least partly covers the rearward panel back face 24B, and preferably is divided into separate first and second magnetic mounting end sheets 70 and 72 adhesively fastened to opposing first and second rearward panel back face narrow ends NE1 and NE2, respectively. See FIG. 6. The narrow end sheets 70 and 72 preferably cover twenty-five percent of the surface of the rearward panel back face 24B.

The magnetic mounting end sheets 70 and 72 preferably are each substantially 1/32 inches thick, and can be a 60 ml Flexible Outdoor Magnetic Sheet bonded to the back face 24B of rearward panel 24. A suitable sheet magnet 70 preferably is a thin layer of plastic, embedded with millions of magnetized steel particles, as described in "Guide to Sheet Magnet" by MAGICALLY MAGNETIC™.

To protect the magnetic mounting end sheets 70 and 72 from damage when assembly 10 is to be used on a rocky, muddy or otherwise rough or abrasive surface, a cushion cover 74 is provided. Cushion cover 74 preferably is a panel or sheet of closed cell high-density, water resistant neoprene foam, similar to that from which forward and rearward panels 22 and 24 are formed, which preferably is 3/32 inches thick and is sized and shaped to match the size and shape of the rearward panel back face 24B. See FIG. 6. The cushion cover 74 is removably secured over rearward panel back face 24B by a suitable cushion cover fastener, preferably in the form of a half inch wide first cushion cover hook and loop fastener strip 78 secured along the periphery of the cushion cover front face 76, and a corresponding half inch wide second cushion cover hook and loop fastener strip 78A secured along the periphery of the rearward panel back face 24B. First and second cushion cover hook and loop fastener strips 78 and 78A are pressed together to releasably fasten cushion cover 74 to rearward panel back face 24B to shield magnetic mounting end sheets 70 and 72.

To releasably secure the assembly 10 in its closed configuration between uses, a locking mechanism 80 preferably is provided. The preferred locking mechanism 80 includes a first locking magnetic sheet 82 secured to the forward panel back face 22B and a second locking magnetic sheet 84 secured to the rearward panel front face 24A. See FIG. 2. The first locking magnetic sheet 82 and the second locking magnetic sheet 84 are positioned on the forward and rearward panels 22 and 24, respectively to register with each other when the forward panel 22 and the rearward panel 24 are pivoted on the pin structure 40 to overlap, so that the magnetism of the first locking magnetic sheet 82 and the second locking magnetic sheet 84 releasably holds the forward and rearward panels 22 and 24 in overlapping relation. It is also contemplated that one of the first and second locking magnetic sheets 82 and 84 is a magnetized sheet, while the other is a non-magnetized steel sheet, since magnetic attraction between the two needed to perform the locking function is still present and performs the same locking function. The first locking magnetic sheet 82 preferably is located at the end of said forward panel 22 opposite the end through which the pin structure 40 passes, and the second locking magnetic sheet 84 is located at the end of said rearward panel 24 opposite the end through which the pin structure 40 passes, to give first and second locking magnetic sheets 82 an 84 maximum mechanical advantage in performing their locking function. First and second locking magnetic sheets 82 and 84 preferably have the same thickness and same manufacturer(s) as recited above for the first and second mounting magnetic narrow end sheets 70 and 72.

An alternative locking mechanism 80 includes a hook and loop fastener patch 92 secured to the front face 22A of the forward panel 22, and a hook and loop fastener strap 94 secured to the back face 24B of the rearward panel 24. See FIG. 10.

To secure assembly 10 in its closed configuration, the strap 94 is wrapped around the edges of the overlapping panels 22 and 24, and releasably secured to the patch 22. When the assembly 10 is needed for use, the user applies a small amount of force to cause the hook and loop fastener patch 92 and hook and loop fastener strap 94 to disengage, freeing the panels to fan apart into their deployed configuration.

The forward and rearward panels 22 and 24 optionally are formed of UV glow-foam to glow at night or in a dark room and recharge from ambient light during the day. The UV glow illuminates and shines through the protective layer PL.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot elative to each other to fan apart to a deployed, open configuration for use by resting a user knee on said forward panel and a user knee on said rearward panel to protect user knees from impact, pressure, discomfort and injury resulting from contact with a support surface on which said knee-cushion assembly rests; and a locking mechanism for releasably holding said knee cushion assembly in its closed configuration, said locking mechanism comprising a first locking magnet secured to said forward panel substantially at said forward panel back face, and a second locking magnet secured to said rearward panel substantially at said rearward panel front face, and positioned to register with said first locking magnet when said forward panel and said rearward panel are pivoted on said pin structure relative to each other to overlap, such that the magnetism of said first locking magnet and said second locking magnet releasably holds said forward and rearward panels in overlapping relation.

2. The knee-cushion assembly of claim 1, wherein said first locking magnet is located at the end of said forward panel opposite said pin structure, and said second locking magnet is located at the end of said rearward panel opposite said pin structure.

3. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot relative to each other to fan apart to a deployed, open configuration for use by testing a user knee on said forward panel and a user knee on said rearward panel to protect user knees from impact, pressure, discomfort and injury resulting from contact with a support surface on which said knee-cushion assembly rests; and a locking mechanism for releasably holding said knee cushion assembly in its closed configuration, said locking mechanism comprising a locking magnet secured to said forward panel substantially at said forward panel back face and a non-magnetic quantity of ferromagnetic material secured to said rearward panel substantially at said rearward panel front face, and positioned to register with said locking magnet when said forward panel and said rearward panel are pivoted on said pin structure relative to each other to overlap, such that the magnetism of said locking magnet acting on said quantity of ferromagnetic material releasably holds said forward and rearward panels in overlapping relation.

4. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot relative to each other to fan apart to a deployed, open configuration for use by resting a user knee on said forward panel and a user knee on said rearward panel to protect user knees from impact, pressure, discomfort and injury resulting from contact with a support surface on which said knee-cushion assembly rests; and a locking mechanism for releasably holding said knee cushion assembly in its closed configuration, said locking mechanism comprising a non-magnetic quantity of ferromagnetic material secured to said forward panel substantially at said forward panel back face and, locking magnet secured to said rearward panel substantially at said rearward panel front face, and positioned to register with said quantity of ferromagnetic material when said forward panel and said rearward panel are pivoted on said pin structure relative to each other to overlap, such that the magnetism of said locking magnet acting on said quantity of ferromagnetic material releasably holds said forward and rearward panels in overlapping relation.

5. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests;

wherein said pin structure engages each of said forward panel adjacent to said forward panel peripheral edge and said rearward panel adjacent to said rearward panel peripheral edge; and wherein said forward panel and said rearward panel are each one of elliptically-shaped and oval-shaped, and each have two opposing narrow ends, and said pin structure engages said forward panel and said rearward panel adjacent to a narrow end of each;

such that when fanned apart on said pin structure said forward and rearward panels cover a broad area, said forward panel front fac and said rearward panel front face are each exposed and presented for use in supporting a user knees.

6. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests;

a mounting magnetic sheet secured to and at least partially covering said rearward panel back face, for removably magnetically fastening said knee-cushion assembly to an upright steel surface.

7. The knee-cushion assembly of claim 6, wherein said mounting magnetic sheet comprises two narrow end sheets, covering said rearward panel narrow ends.

8. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect the user knees from impact, pressure, discomfort and injury resulting from contact with a support surface on which said knee-cushion assembly rests;

wherein said forward panel front face and said rearward panel front face are each covered with a protective layer of textured liquid UV ink such that the ink is resistant to abrasion.

9. The knee-cushion assembly of claim 8, wherein said forward and rearward panels are formed of UV glow-foam to glow in the dark and to recharge from ambient light, such that UV light from said UV glow-foam illuminates and shines through said protective layer.

10. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests;

wherein said pin structure engages each of said forward panel adjacent to said forward panel peripheral edge and said rearward panel adjacent to said rearward panel peripheral edge;

such that when said forward panel and said rearward panel are fanned apart on said pin structure, said forward panel front face and said rearward panel front face are each exposed and presented for use in supporting a user knee;

wherein said forward panel and said rearward panel are each one of elliptically-shaped and oval-shaped, and each have two opposing narrow ends, and said pin structure engages said forward panel and said rearward panel adjacent to a narrow end of each;

such that when fanned apart on said pin structure said forward and rearward panels cover a broad area, wherein said rearward panel back face is at least partly covered with a mounting magnetic sheet for removably magnetically fastening said knee-cushion assembly to an upright steel surface.

11. The knee-cushion assembly of claim 10, wherein said mounting magnetic sheet comprises two narrow end sheets, covering said rearward panel narrow ends.

12. The knee-cushion assembly of claim 11, additionally comprising a cushion cover comprising is a sheet and a cushion cover fastener for securing said cushion cover over and against said rearward panel back face to protectively cover said magnetic mounting end sheets.

13. The knee-cushion assembly of claim 11, wherein said rearward recess covered by one of said narrow end sheets.

14. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests wherein said pin structure engages each of said forward panel adjacent to said forward panel peripheral edge and said rearward panel adjacent to said rearward panel peripheral edge;

such that when said forward panel and said rearward panel are fanned apart on said pin structure, said forward panel front face and said rearward panel front face are each exposed and presented for use in supporting a user knee;

wherein said forward panel and said rearward panel are each one of elliptically-shaped and oval-shaped, and each have two opposing narrow ends, and said pin structure engages said forward panel and said rearward panel adjacent to a narrow end of each;

such that when fanned apart on said pin structure said forward and rearward panels cover a broad area, wherein said rearward panel back face is at least partly covered with a mounting magnetic sheet for removably magnetically fastening said knee-cushion assembly to an upright steel surface;

wherein said mounting magnetic sheet comprises two narrow end sheets, covering said rearward panel narrow ends;

additionally comprising a quantity of anaerobic adhesive between said screw and the interior of said tube to prevent them from loosening and disengaging from each other.

15. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests;

wherein said pin structure comprises a female portion comprising an internally threaded tube with a tube open end and a tube closed end covered by a tube head having a width greater than the width of said tube, and a male portion including a screw with a threaded shaft having a screw head at one end of said screw; and said forward panel comprises a forward panel pin passing passageway and said rearward panel comprises a rearward panel pin passing passageway, wherein said forward pin passing passageway registers with said rearward panel pin passing passageway, and said internally threaded tube of said female portion of said pin structure passes through registering said pin passing passageways in said forward and rearward panels, and said threaded shaft of said male portion is screwed into said internally threaded tube;

such that said tube head and said screw head abut and hold said forward panel and said rearward panel in face-to-face abutting relation.

16. The knee-cushion assembly of claim 15, wherein said pin structure forward and rearward ends are fitted with corresponding forward and rearward washers, wherein said forward washer fits between said forward panel and said tube head and said rearward washer fits between said rearward panel and said pin structure screw head.

17. The knee-cushion assembly of claim 16, additionally comprising a center washer surrounding said pin structure between said forward panel and said rearward panel.

18. The knee-cushion assembly of claim 16, wherein said pin structure is sized in length to be less than the combined thickness of said forward and rearward panels, and wherein said pin passing passageway in said forward panel is counter-sunk into said forward panel front face to define a forward recess having a diameter matching that of said forward washer into which said pin structure forward end including said forward washer is seated.

19. The knee-cushion assembly of claim 18, additionally comprising a cover sheet covering said forward recess.

20. The knee-cushion assembly of claim 18, wherein said pin passing passageway in said rearward panel is counter-sunk into said rearward panel front face to define a rearward recess having a diameter matching that of said rearward washer into which said pin structure rearward end including said rearward washer is seated.

21. The knee-cushion assembly of claim 20, additionally comprising recess filler material within said forward and rearward recesses.

22. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot relative to each other to fan apart to a deployed, open configuration for use by resting a user knee on said forward panel and a user knee on said rearward panel to protect user knees from impact, pressure, discomfort and injury resulting from contact with a support surface on which said knee-cushion assembly rests; and a mounting magnet secured to said rearward panel substantially at said rearward panel back face for removably magnetically fastening said knee-cushion assembly to an upright steel surface.

23. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests;

wherein said pin structure comprises a female portion comprising an internally threaded tube with a tube open end and a tube closed end covered by a tube head having a width greater than the width of said tube, and a male portion including a screw with a threaded shaft having a screw head at one end of said screw; and said forward panel comprises a forward panel pin passing passageway and said rearward panel comprises a rearward panel pin passing passageway, wherein said forward pin passing passageway registers with said rearward panel pin passing passageway, and said internally threaded tube of said female portion of said pin structure passes through registering said pin passing passageways in said first and second panels, and said threaded shaft of said male portion is screwed into said internally threaded tube;

such that said tube head and said screw head abut and hold said forward panel and said rearward panel in face-to-face abutting relation;

wherein said pin structure forward and rearward ends are fitted with corresponding forward and rearward washers, wherein said forward washer fits between said forward panel and said tube head and said rearward washer fits between said rearward panel and said pin structure screw head;

additionally comprising a mounting magnet adhesively secured to said rearward panel back face, having sufficient magnetic force to support said knee-cushion assembly when placed against a upright steel surface.

24. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests; and a locking mechanism for releasably holding said knee cushion assembly in its closed configuration;

wherein said locking mechanism comprises a locking magnetic sheet secured to said forward panel back face and non-magnetic steel sheet secured to said rearward panel front face positioned to register with said locking magnetic sheet when said forward panel and said rearward panel are pivoted on said pin structure relative to each other to overlap, such that the magnetism of said locking magnetic sheet releasably holds said forward and rearward panels in overlapping relation.

25. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests; and a locking mechanism for releasably holding said knee cushion assembly in its closed configuration;

wherein said locking mechanism comprises a non-magnetic steel sheet secured to said forward panel back face and locking magnetic sheet secured to said rearward panel front face positioned to register with said steel sheet when said forward panel and said rearward panel are pivoted on said pin structure relative to each other to overlap, such that the magnetism of said locking magnetic sheet releasably holds said forward and rearward panels in overlapping relation.

26. A knee-cushion assembly, comprising:

a forward panel comprising cushion material and having a forward panel center point and a forward panel peripheral edge and having a forward panel front face and a forward panel back face;

a rearward panel comprising cushion material and having a rearward panel center point and a rearward panel peripheral edge and having a rearward panel front face and a rearward panel back face;

a pin structure pivotally engaging said forward panel at a point between said forward panel center point and said forward panel peripheral edge, and pivotally engaging said rearward panel at a point between said rearward panel center point and said rearward panel peripheral edge, such that said forward panel and said rearward panel are pivotally interconnected to pivot relative to each other into an overlapping, closed configuration for compact storage, and to pivot apart to fan to a deployed, open configuration for use by resting a user knee on said forward panel and a user knee on said rearward panel to protect user knees from impact, pressure, discomfort and injury resulting from contact with a support surface on which said knee-cushion assembly rests; and a locking mechanism for releasably holding said knee cushion assembly in its closed configuration;

wherein said locking mechanism comprises a first locking magnetic sheet secured to said forward panel back face and a second locking magnetic sheet secured to said rearward panel front face positioned to register with said first locking magnetic sheet when said forward panel and said rearward panel are pivoted on said pin structure relative to each other to overlap, such that the magnetism of said first locking magnetic sheet and said second locking magnetic sheet releasably holds said forward and rearward panels in overlapping relation.

27. The knee-cushion assembly of claim 26, wherein said first locking magnetic sheet is located at the end of said forward panel opposite said pin structure, and said second locking magnetic sheet is located at the end of said rearward panel opposite said pin structure.

* * * * *